US005458381A

United States Patent [19]

Dziuk et al.

[11] Patent Number: 5,458,381

[45] Date of Patent: Oct. 17, 1995

[54] DOOR WITH A LATCH AND/OR BOLT LOCK AND HANDLE MOUNTING FOR SAME

[75] Inventors: Richard Dziuk, Arolsen; Horst Jäger, Edertal-Buhlen, both of Germany

[73] Assignee: HEWI Heinrich Wilke GmbH, Arolsen, Germany

[21] Appl. No.: 4,994

[22] Filed: Jan. 15, 1993

[30] Foreign Application Priority Data

Jan. 17, 1992 [DE] Germany ..... 42 01 069.1

[51] Int. Cl.[6] ..... E05B 3/00

[52] U.S. Cl. ..... 292/336.3

[58] Field of Search ..... 292/336.3, 229, 292/92

[56] References Cited

U.S. PATENT DOCUMENTS

| | | | |
|---|---|---|---|
| 1,815,584 | 7/1931 | Prinzler | 292/92 X |
| 2,991,107 | 7/1961 | Eichacker et al. | 292/336.3 X |
| 3,869,159 | 3/1975 | Eads | 292/336.3 X |
| 4,597,600 | 7/1986 | Wilke et al. | 292/336.3 |
| 4,982,986 | 1/1991 | Gressett et al. | 292/336.3 |

FOREIGN PATENT DOCUMENTS

| | | |
|---|---|---|
| 467039 | 1/1974 | Australia . |
| 0191289 | 1/1986 | European Pat. Off. . |
| 1024836 | 4/1953 | France . |
| 2292835 | 6/1976 | France . |
| 3116706 | 11/1982 | Germany . |
| 3533361 | 8/1986 | Germany . |
| 8808114 | 8/1988 | Germany . |
| 3825303 | 2/1989 | Germany . |
| 2167116 | 5/1986 | United Kingdom . |

*Primary Examiner*—Peter M. Cuomo
*Assistant Examiner*—Jerry Redman
*Attorney, Agent, or Firm*—Michael J. Striker

[57] ABSTRACT

A door (1) is described which has a locking member (4) which is actuated by a handle (6) which can be swiveled around a vertical swivel axis (12). A deflecting gearing having a gearing part acting on the locking member and a second gearing part which can be connected with the handle is arranged in a fastening device of a handle mounting. The locking member can be actuated optionally by pressing or pulling on the handle. A handle mounting suitable for the latter is also described.

28 Claims, 5 Drawing Sheets

DOOR WITH A LATCH AND/OR BOLT LOCK AND HANDLE MOUNTING FOR SAME

BACKGROUND OF THE INVENTION

The invention concerns a door comprising a lock having a locking member, a handle, at least one fastening device for mounting the handle on the door, the handle being supported in the fastening device so as to be swivelable around a swivel axis arranged substantially vertically and parallel to the door leaf, and a deflecting mechanism which at least converts a swiveling of the handle effected in a preselected swiveling direction into an opening movement of the locking member. The invention also concerns a handle mounting for such a door.

Traditionally, doors are opened by handles in the form of door latch handles, knobs or the like whose swivel or rotational axes are arranged coaxially relative to the axis of rotation of an actuating member for the respective lock. The actuating member is generally a square spindle penetrating a lock nut which is a rotatable structural component part of a door lock inserted in a lock pocket of the door and, when rotated, either pulls back a locking member in the form of a latch or bolt arranged at the side of the door into an open position so that the door can be opened or lets it slide into a projecting position so that, for instance, it catches in an associated opening of the frame enclosing the door so as to hold the door in its closed position. In addition to this, for example, there are swinging doors and also so-called smoke-protection doors which were previously constructed like swinging doors and provided with swinging door handles having handle bars which are rigidly attached and usually vertically arranged in the mounted state. In the future such smoke-protection doors will be constructed with latch locks and therefore also with swivelable handles. Previously only the conventional door latch handles, knobs etc. were available for this purpose so that swinging door handle bars or the like which are often preferred for formal reasons and are presently constructed in many variants could not be used.

SUMMARY OF THE INVENTION

Therefore, the invention has the aim of providing the door with a conventional swinging door handle or the like in such a way that its locking member can be at least opened by swiveling the swinging door handle around a substantially vertical swivel axis.

A further object is to provide a handle mounting for such a door.

Yet another object of the invention is to provide a door with a lock and a handle which can be swiveled about a vertical axis as well as means for opening and closing the door.

To solve this problem it would be conceivable in principle to provide the swinging door handle with a force transmitting member in such a way that the latter acts on a conventional door latch handle and presses it down when the swinging door handle is swiveled in the direction of the door leaf (EP 0 191 289 B1). However, such a solution is undesirable for reasons of cost since it would require a handle bar or the like in addition to the conventional door latch handle. Moreover, such a construction is less attractive in formal respects because it has many different visible parts. For this reason such a construction is also not satisfactory with respect to hygiene since the many individual parts form dirt-collecting corners which impede cleaning and therefore require frequent and cumbersome cleaning work when used in hospitals or the like. Finally, it is difficult to use the known mechanism for a door which must be opened toward the user.

In contrast, the invention has the further object of constructing the doors or handle mountings mentioned above in such a way that only the handles themselves and the fastening devices required for mounting them on the door are visible.

According to yet another object of this invention, the swiveling movement of the handles is to be adapted to the opening movements of the doors, i.e. it should be possible to open the locking member by exerting a pressing or pulling movement on the handle, as needed, without substantial visible differences between the handle mountings.

These and other objects of this invention are solved by a deflecting mechanism which includes a gearing and has a first rotatable gearing part acting on the locking member and a second gearing part which is rotatable around the swivel axis and can be connected with the handle.

A handle mounting for a door having a lock, a locking member and a handle comprises in accordance with this invention at least one fastening device for mounting the handle on the door in such a manner that the handle is supported in the fastening device so as to be swivelable around a swivel axis arranged substantially vertically and parallel to the door leaf, and a deflecting mechanism which at least converts a swiveling of the handle effected in a preselected swiveling direction into an opening movement of the locking member, said deflecting mechanism including a gearing which has a first rotatable gearing part for acting on the locking member and a second gearing part which is rotatable around the swivel axis and can be connected with the handle.

The invention provides the advantage that conventional impact handles, handle bars or the like which are arranged so as to be substantially vertical and rigid when mounted can now also be used for actuating the latch or bolt at least when opening the door. The gearing can have a comparatively small construction and can be integrated in the fastening device which is advisably enclosed on all sides by a cover. Therefore, essentially only the handle itself can be seen, as was previously the case, and a number of formal problems are solved which until now could only be solved with rigid handles.

Further advantageous features of the invention are provided in the subclaims.

The invention is explained in more detail in the following in connection with the attached drawing with reference to embodiment examples.

DESCRIPTION OF THE PREFERRED EMBODIMENTS

Figure 1:
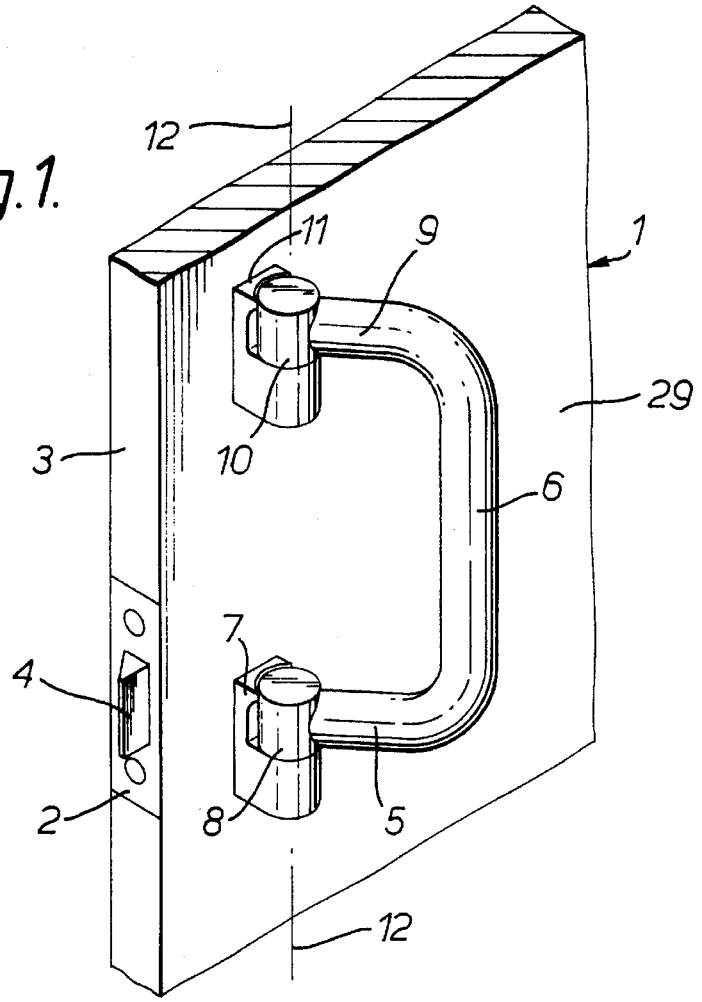
FIG. 1 shows a perspective view of a door with a handle mounting according to the invention.

FIG. 1 is a schematic view of a door 1, according to the invention, with a lock 2 which is arranged in a lock pocket constructed in a lateral end face 3 of the door 1 and is provided with a locking member 4 in the form of a latch or a bolt. FIG. 1 also shows a schematic view of a handle mounting for the door 1 which preferably, but not necessarily, serves as a smoke-protection door. The bottom portion of FIG. 1 shows the part of a fastening device of the mounting acting on the door lock 2 and holding one angled end 5 of a handle 6 and the top portion of FIG. 1 shows the part of the mounting holding the other end of the handle 6. The fastening device receives a short, rigidly arranged holder part 7 for a gearing and a receptacle 8 for the handle 6. The receptacle 8 is rotatably supported at the holder part 7. The handle 6 is constructed as a handle bar which is fastened substantially vertically at the door leaf in the mounted state and has a second angled end 9. This end 9 is fastened at a second receptacle 10 which is rotatably supported in another rigid holder part 11. A swivel axis for the handle 6 is designated by 12. When the handle 6 is mounted this swivel axis 12 is arranged so as to be substantially vertical and accordingly also perpendicular to the movement direction of the locking member 4 and so as to be perpendicular to the axis of rotation of a conventional lock follower or the like (hereinafter simply called lock nut) and parallel to the end face 3.

Figure 2:
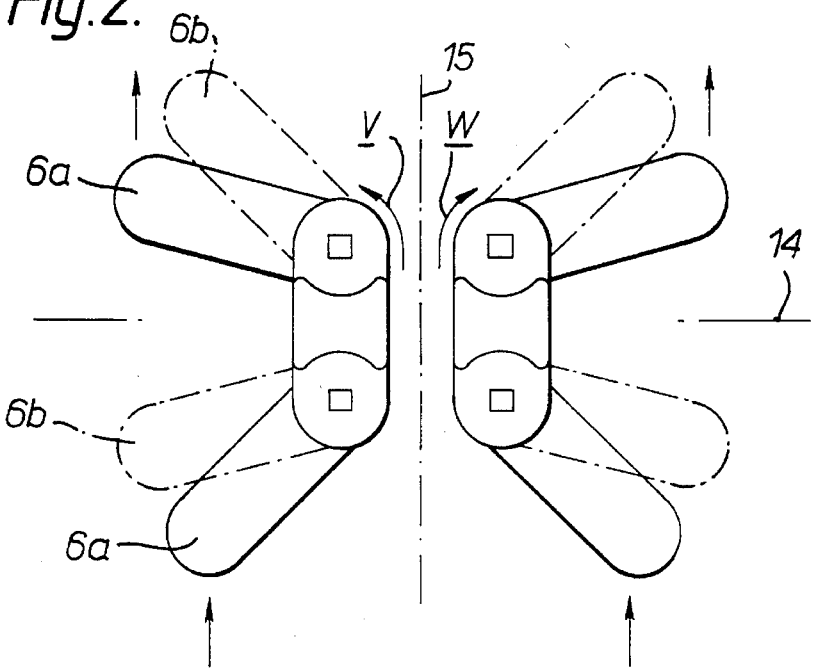
FIG. 2 is a schematic top view of the possible swiveling movements of the handle of the mounting according to FIG. 1.

FIG. 2 is a schematic view of imaginary center planes 14 of two smoke-protection doors which are situated on each side of a plane 15 arranged perpendicular to the center planes 14. By way of example, the left-hand side of FIG. 2 shows a door which opens in the direction of an arrow v, or to the right. The right-hand side of FIG. 2 on the other hand shows a door opening in the direction of an arrow w, or to the left. The handle 6 is shown in a closing position **6*a* indicated by solid lines. According to a particularly preferred embodiment form of the invention the handle 6 must be swiveled out of this closing position 6*a* in the direction of the respective arrow into an open position 6*b* shown in dashes so as to open the latch and then the door. This shows that the handle 6 should be situated at a comparatively slight distance from the center plane 14 in its normal closed position 6*a*, preferably on the side of the door at which the handle is pulled, so as to obtain a favorable lever action and exploitation of force as is shown in FIG. 2 for the two upper handles. On the other hand, if pressure is to be exerted on the handle 6 for the purpose of opening the door or its latch, which is the case with the two lower handles in FIG. 2, the handle 6 should form a greater angle up to approximately 45° with the center plane 14 in its closing position 6*a* to achieve a favorable lever action. Moreover, the distance between the handle 6 and the door leaf must be at least great enough in all positions 6*a*, 6*b*** to prevent injury when operating the door.

According to FIGS. 3 to 6 and the embodiment form which is felt at present to be the best, the holder part 7 contains a lower part with a mounting plate 18 intended for mounting on a door and having screw holes 17 and an outer cover which is designated in its entirety by 19. The mounting plate 18 is provided with a circular opening in which a rear cylindrical portion of a first gearing part in the form of a driver sleeve 20 is supported so as to be rotatable around a first axis **20*a*. The driver sleeve 20 has a non-circular, preferably square, inner cross section and serves to receive an actuating member 21 having a correspondingly non-circular outer cross section, preferably a conventional square spindle which penetrates a lock nut and can be fastened in the driver sleeve 20 so as to be fixed with respect to axial displacement by means of a radially arranged fastening screw, not shown. Moreover, the driver sleeve 20 has a circular disk 22 at its inner end which is supported at the mounting plate 18 at the rear, while its other end is axially secured by a spring ring 23**.

A driver pin 24 or the like whose axis is arranged parallel to and at a distance from the first axis **20*a* and which preferably projects vertically away from the inner end face of the disk 22 parallel to the mounting plate 18 is arranged on the front side of the disk 22. Moreover, the driver pin 24 lies within an imaginary cylinder whose diameter is at most equal to the greatest diameter of the driver sleeve 20**.

Further, the lower part has two parallel holding plates 25 which project from the mounting plate 18 in a substantially vertical direction. The driver sleeve 20 is rotatably supported between these holding plates 25 (FIG. 3) which lie one above the other when mounted on the door. The two holding plates 25 have coaxial bearing bore holes 26 (FIG. 4) for rotatably supporting a second gearing part which is constructed e.g. as a substantially cylindrical roller 27 and in the mounted state is arranged substantially in front of the first gearing part as seen facing the door. The second gearing part is rotatable around a second axis 28 which is preferably arranged so as to be substantially perpendicular to the first axis **20*a* and in the mounted state of the mounting according to FIG. 4 so as to be substantially vertical when the actuating member 21 is perpendicular to the door leaf 29, as is conventional (FIG. 1**). The deflecting mechanism formed by the two gearing parts is accordingly arranged in its entirety in the lower fastening device of the handle mounting.

Figure 6:
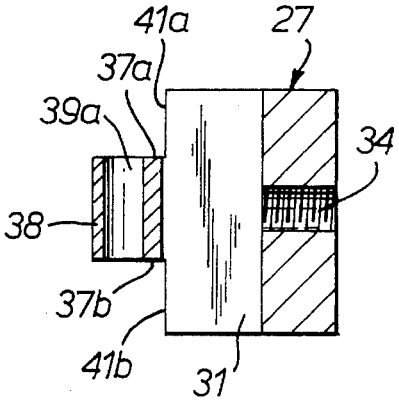
FIG. 6 shows a section enlarged relative to FIG. 4 only through a roller of the gearing.

As shown particularly by FIG. 6, the roller 27 contains a central passage 31 for receiving a rod 32. This rod 32 is connected with the roller 27 so as to be fixed with respect to rotation and against axial displacement relative to it by a fastening screw 33 which penetrates a radial threaded bore hole 34 (FIG. 6) of the roller 27. A cylindrical bearing sleeve 35 is also supported in the bearing bore holes 26. The bearing sleeve 35 has e.g. a non-circular, particularly square, inner cross section and is supported at the inner sides of the holding plates 25 by a flange-like edge portion. In this case, the passage 31 has a corresponding inner cross section while the rod 32 is constructed e.g. as a square spindle and with a corresponding outer cross section and penetrates the passage 31 as well as the two bearing sleeves 35 and is accordingly already connected with the latter so as to be fixed with respect to rotation relative to them. In this way the roller 27 is mounted and supported in a simple manner.

Figure 5:
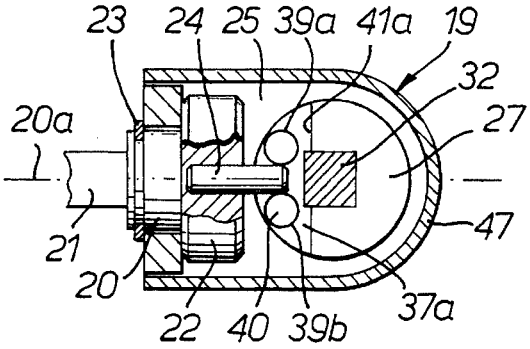
FIG. 5 shows a section along line V—V of FIG. 4.

According to FIG. 6, the roller 27 is provided at both ends with recesses 37*a* and 37*b*, respectively, which have an arc-shaped cross section according to FIG. 5 and leave a likewise arc-shaped base 38. According to FIGS. 5 and 6 two continuous bore holes 39*a* and 39*b* are constructed in this base 38. Their axes are arranged parallel to the axis of the passage 30 and parallel to the second axis 28, respectively, and at a distance from one another in the circumferential direction of the roller 27.

The bore holes 39*a,b* optionally serve to receive the guide part 40, e.g. a cylindrical pin. As shown particularly by FIGS. 4 and 5, the arrangement is effected in such a way that the driver pin 24 projects parallel to the first axis 20*a* into one of the two recesses 37*a,b* until it is carried along in one or the other rotating direction, as desired, by the guide part 40 of the roller 27 when the roller 27 rotates around the second axis 28 and the driver sleeve 20 is accordingly rotated around the first axis 20*a*. The guide part 40 therefore acts as a guide for the driver pin 24. Of course, the guide part 40 can also be a guide wall or the like formed on at the base 38 and/or at the outer surface area of the roller 27. In either case, the two gearing parts are provided with members which can be coupled in a positive-locking manner in at least one rotating direction.

To realize the opening movements described with reference to FIG. 2, it is only necessary to press-fit the guide part 40 into the corresponding bore hole 39*a,b* and allow it to project into the corresponding recess 37*a,b*. Depending on which recess 37*a,b* the guide part 40 projects into, the disk 22 must be arranged in the position shown in FIG. 3 or rotated by 180° so that its driver pin 24 occupies the position 24*a* shown in dashed lines in FIG. 3. The other respective bore hole 39*a,b* preferably remains free, although inserting another guide part into it could serve to close the latch again when the roller 27 is moved backward. However, this is not usually necessary since the actuating member 21 is generally rotated back by the conventional restoring spring arranged in the lock so that the driver pin 24 contacts the guide part 40 and the roller 27 accordingly rotates the parts connected with it back into the closed position. In addition, the wall portions 41*a,b* formed by the recesses 37*a,b* and arranged parallel to the second axis 28 can also be used to rotate the driver pin 24 back into the initial position by rotating back the roller 27.

Due to the described construction, the overall width of the mounting part in the direction of an axis perpendicular to the axes 20*a* and 28 substantially depends only on the greatest diameter of the driver sleeve 20 or on the diameter of the roller 27 which is dimensioned so as to be correspondingly large (FIG. 5).

The receptacle 8 is fastened at the rod 32. This receptacle 8 has a first passage 43 serving to receive the rod 32 and having a corresponding inner cross section and a threaded bore hole perpendicular to the latter for a fastening screw 44. The receptacle 8 also has a second passage extending perpendicular to the first passage 43 and serving to receive e.g. a cylindrical mounting pin 45 which projects perpendicularly out of a respective end face of the end 5 of the handle 6. The mounting pin 45 has a transverse bore hole associated with a fastening screw 46 projecting through it. The fastening screw 46 is screwed into a threaded bore hole extending parallel to the first passage 43 and constructed in the receptacle 8 to connect the end 5 of the handle 6 with the receptacle 8 so as to be fixed with respect to rotation and axial displacement relative to it. The overall arrangement is preferably effected in such a way that the handle 6 must be pressed in the case of a door opening outward and pulled in the case of a door opening inward so as to rotate the driver sleeve 20 in such a way that the actuating member 21 opens the locking member.

Moreover, the outer cover 19 is constructed from a number of parts and has a rigid portion 47 receiving the lower part and the gearing, a portion 48 placed on the rotatable receptacle 8, and a portion 49 which is clipped onto the portion 48 after tightening the fastening screw 46.

Figure 3:
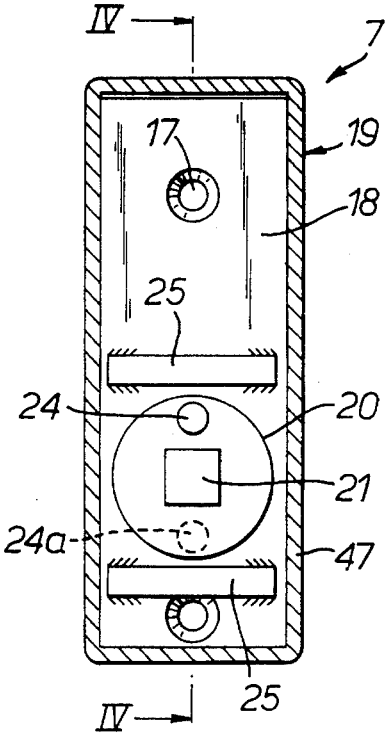
FIG. 3 is a front view in longitudinal section through the part of a handle mounting according to FIG. 1 for a smoke-protection door having a gearing according to the invention, which part acts on a door lock, only a first part of the gearing is shown.
Figure 4:
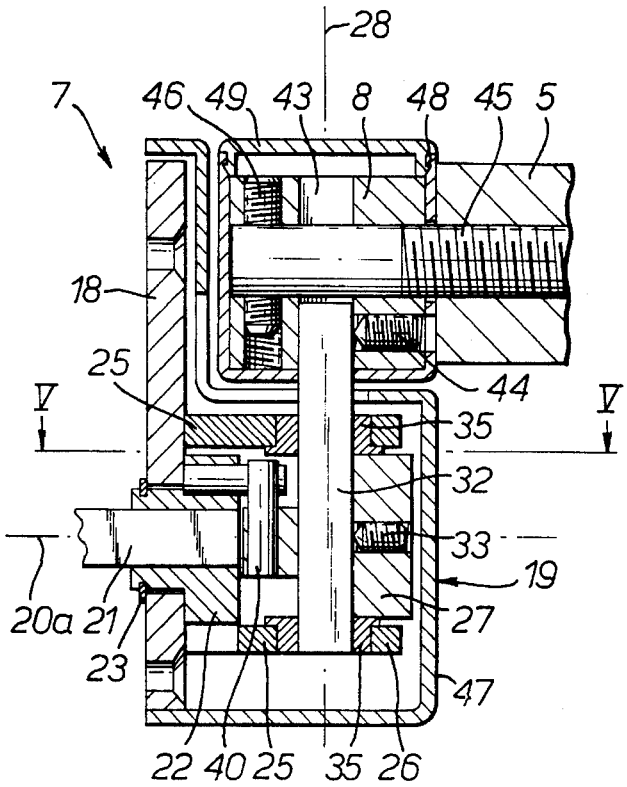
FIG. 4 shows a section along line IV—IV of FIG. 3 through the entire mounting.

As shown particularly in FIGS. 3 to 5, the gearing formed from the gearing parts 20 and 27 is distinguished in that its second rotational axis 28 extends so as to be substantially perpendicular to the first rotational axis 20*a* and, when the mounting is mounted, parallel to the door leaf 29 or to the end face 3 of the door. In addition, the first axis 20*a* is arranged so as to be parallel to the axis of the driver pin 24. Since the holding plates 25 are situated one over the other, the second axis 28 is arranged in such a way that it substantially intersects the first axis 20*a*, and the guide part 40 is arranged inside the outer contour of the roller 27, as shown particularly by FIG. 5, the gearing according to FIGS. 3 to 5 enables an overall width which is small enough, while still sufficiently stable, so that the handle mounting and holder part 7 with a maximum of approximately 34 cm can be constructed so as also to be sufficiently narrow for frame doors, etc. whose frames normally have a width of no more than approximately 42 mm.

Figure 7:
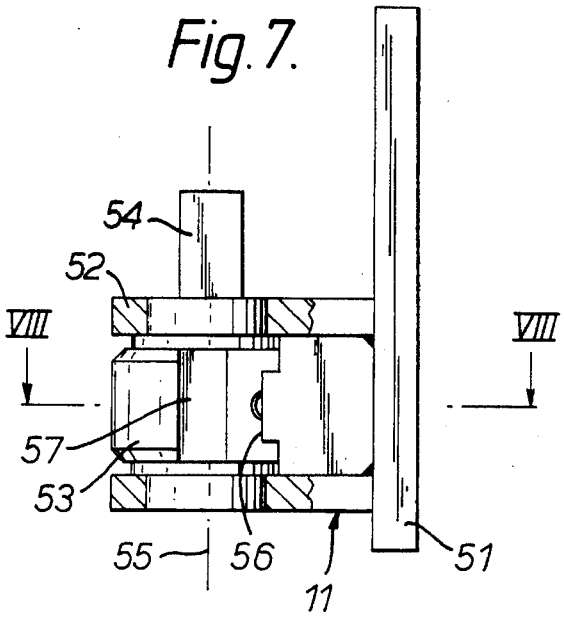
FIG. 7 is a side view in partial section of a part of the mounting according to FIG. 1 arranged at the opposite end of the handle.
Figure 8:
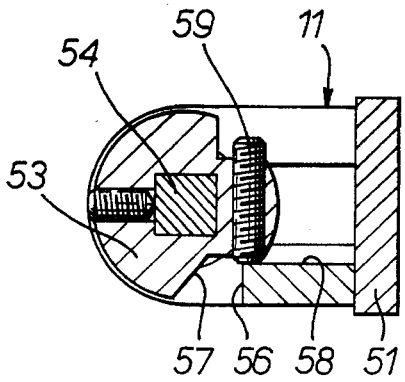
FIG. 8 shows a section along line VIII—VIII of FIG. 7.

The holder part 11 which is shown particularly in FIGS. 7 and 8 also serves to support the upper end of the handle 6 in FIG. 1 in a rotatable manner. It contains a lower part with a mounting plate 51 having screw holes and two holding plates 52 which project perpendicularly from the latter and rotatably support a roller 53 between them. This support is advisably effected with the aid of bearing sleeves similar to bearing sleeves 35 and by a rod 54 which projects through the bearing sleeves and the roller 53 and is constructed e.g. as a square spindle. The arrangement is effected in such a way that the second axis 28 (FIG. 4) is coaxial with the rotational axis 55 of the roller 53 and rod 54 in the mounted state.

In a manner analogous to FIG. 4, the receptacle 10 corresponding to receptacle 8 can be rotatably supported from an end of the rod 54 projecting out of one of the holding plates 52 in an upward or downward direction. The upper handle end 9 is fastened at the receptacle 10 in a corresponding manner. The holder part 11 advisably has a first fitting 56, which cooperates with a stop face 57 worked into the circumference of the roller 53, and a second stop 58. This second stop 58 cooperates with an adjusting screw 59 which is screwed into a threaded bore hole of the roller 53 which extends perpendicularly to the axis 55 along a secant and has an end projecting out of the roller 53 by a preselected distance and facing the stop 58. The first stop 56 and the stop face 57 serve to determine the travel of the rotating movement of the roller 53 or handle 6 in one direction, preferably in the direction of the closed position. On the other hand, the stop 58 and the adjusting screw 59 serve to adjust the travel of the rotating movement of the roller 53 and handle 6 in the opposite direction, preferably in the direction of the open position, to a preselected value regardless of the type of door lock used in any particular instance. The stops provide the advantage that the end positions of the handle 6 are determined by the holder part 11 and not by the door lock and the latter is protected against overloading.

Finally, in order to preserve and/or reinforce the restoring springs provided in the door locks at least one restoring spring could also be arranged in the holder part 11, which restoring spring is tensioned when turning the handle into the open position and moves the handle back into the closing position when the latter is subsequently released. Moreover, the described construction makes it possible to construct the holder part 11 so as to be at least as narrow as the holder part 7 so as to render it suitable for frame doors with frames having a width of only 42 mm for example.

If especially narrow mountings corresponding to FIGS. 3 to 8 are not required, it is possible to use a handle mounting and a gearing according to FIGS. 9 to 14. In this case the handle mounting contains a door plate 61 which is constructed for instance as a longitudinal plate and has a rigidly arranged holder part 62 for a gearing and a receptacle for a handle 64, which receptacle is supported at the holder part 62 so as to be rotatable. The handle 64 can be constructed corresponding to the handle 6 according to FIG. 1. The door plate 61 has an opening 65 for a profile lock cylinder or the like at its lower end.

In addition to the holder part 62 having a mounting plate 66 provided with screw holes for mounting on the door, the door plate 61 according to FIGS. 9 to 14 contains an outer cover designated in its entirety by 67. The mounting plate 66 is provided with a circular opening in which a rear cylindrical portion of a first gearing part in the form of a driver sleeve 68 is supported so as to be rotatable around a first axis 68*a*. The driver sleeve 68 has a non-circular, preferably square inner cross section and serves to receive an actuating member 69 having a correspondingly non-circular outer cross section, preferably a conventional square spindle which penetrates the lock nut and is fastened in the driver sleeve 68 so as to be fixed against axial displacement by a radially arranged fastening screw, not shown. To provide the driver sleeve 68 with a sufficiently secure fit in the comparatively flat mounting plate 66, a bearing bush 70 is inserted in its opening which is supported at the inside of the mounting plate 66 by a collar 71 and can be connected with it by welding or the like. The driver sleeve 68 has a radially projecting arm 72 at its inner end and is supported at the collar 71 by one end, while being axially secured by a spring ring 73 at its other end which projects out of the bearing bush 70.

A driver pin 74 whose axis is arranged parallel to and at a distance from the first axis 68*a* is fastened at the free end of the arm 72 and preferably projects perpendicularly from the inner end face of the driver sleeve 68, which inner end face is parallel to the mounting plate 66.

Figure 12:
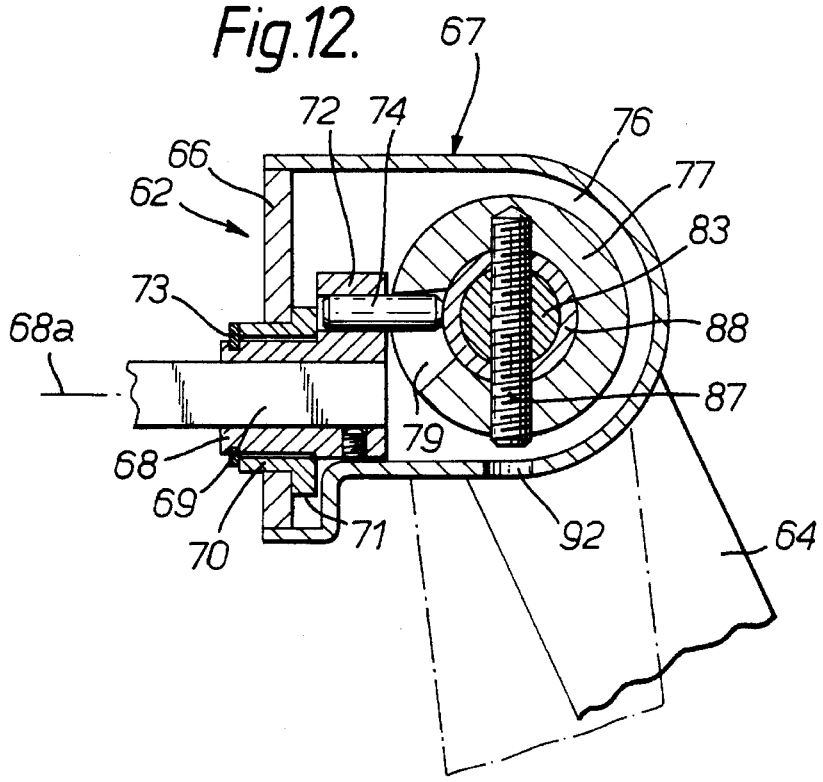
FIG. 12 shows a section along line XII—XII of FIG. 11.

Further, the lower part has two parallel holding plates 76 which project substantially vertically from the mounting plate 66 and between which the driver sleeve 68 is arranged in such a way (FIG. 9) that its arm 72 can be moved in a reciprocating manner around a preselected angle of rotation, e.g. 30° or 45° . The two holding plates 76 have coaxial bearing bore holes for the rotatable support of a second gearing part which is preferably constructed as a cylindrical roller 77 and, when mounted, is arranged substantially in front of the first gearing part, as seen facing the door, in the embodiment form according to FIGS. 3 to 6. The second gearing part is rotatable around a second axis 78 which is preferably substantially perpendicular to the first axis 68*a* and arranged substantially vertically according to FIG. 11 in the mounted state of the mounting when the actuating member 69 is perpendicular to the door leaf, as is conventional. The roller 77 shown in an enlarged view in FIGS. 13 and 14 has at least one cut out portion 79 in its outer surface area into which the driver pin 74 projects and whose upper side is defined in the embodiment example by a wall portion constituting a guide part 80 for the driver pin 74. This guide part 80 is arranged at an inclination relative to the second axis 78 and is preferably constructed as a straight-line guide, although it can also extend in an arc-shaped manner and be directed toward either side of the center plane 81 of the roller 77 as is indicated by solid and dashed lines 80, 80*a*. The driver pin 74 can accordingly be swiveled up or down into an operating position by rotating the roller 77 out of its center position indicated in FIG. 9 which corresponds to the rest position. However, this rotating movement is only possible because the two axes 68*a*, 78 corresponding to FIG. 12 are at a distance from one another without intersecting one another such that the axis 78 is situated approximately at the height of the axis of the driver pin 74. The driver pin 74 is arranged within an imaginary cylinder whose diameter is at most equal to the greatest diameter of the driver sleeve 68 and width of the roller 77.

The rotation of the roller 77 is effected by the handle 64 which has a mounting pin 82 at one end which projects perpendicularly from the end face of the handle 64 and is coupled with a rod 83 projecting through a coaxial passage of the roller 77 so as to be fixed with respect to rotation relative to it. The rod 83 is connected with the widened receptacle 84 (see also FIGS. 9 and 10) at its part projecting out of the roller 77. The receptacle 84 has a transverse bore hole 85 receiving the pin 82 and an axial bore hole for a fastening screw 86. The rod 83 in turn is connected so as to be fixed with respect to rotation and axial displacement by a fastening screw 87 which penetrates the rod 83 and the roller 77 transversely, so that a rotational movement of the handle 64 is transmitted to the actuating member 69 in at least one rotating direction via the roller 77, the guide part 80 acting on the driver pin 74, and the driver sleeve 68. The rod 83 has a preferably cylindrical shape and the roller 77 is provided with a cylindrical passage. Further, the rod 83 can simultaneously be supported in the bearing bore holes of the holding plates 76 so as to be rotatable and can accordingly support the roller 77 so as to be rotatable, for which purpose the latter must also be connected with the rod 83 by the fastening screw 87 so as to be fixed with respect to rotation relative to it. Alternatively, the roller 77 can be penetrated by an additional bearing sleeve 88 which projects into the bearing bore holes of the holding plates 76 and receives the rod 83. In this case the fastening screw 87 must also radially penetrate the bearing sleeve 88 so as to achieve the required locking against rotation and so as to be secured axially.

Figure 13:
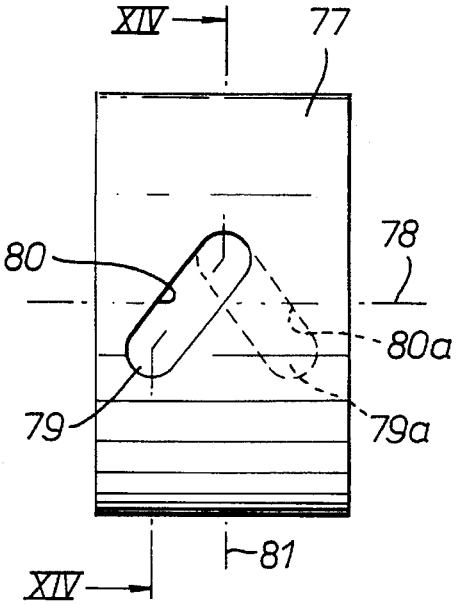
FIG. 13 shows an enlarged front view of a roller of the gearing according to FIGS. 11 and 12.
Figure 14:
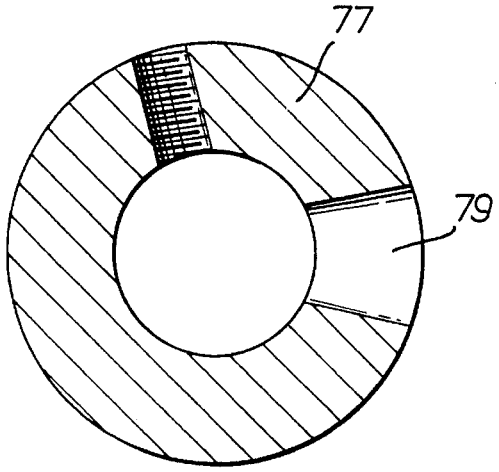
FIG. 14 shows a section along line XIV—XIV of FIG. 13.
Figure 9:
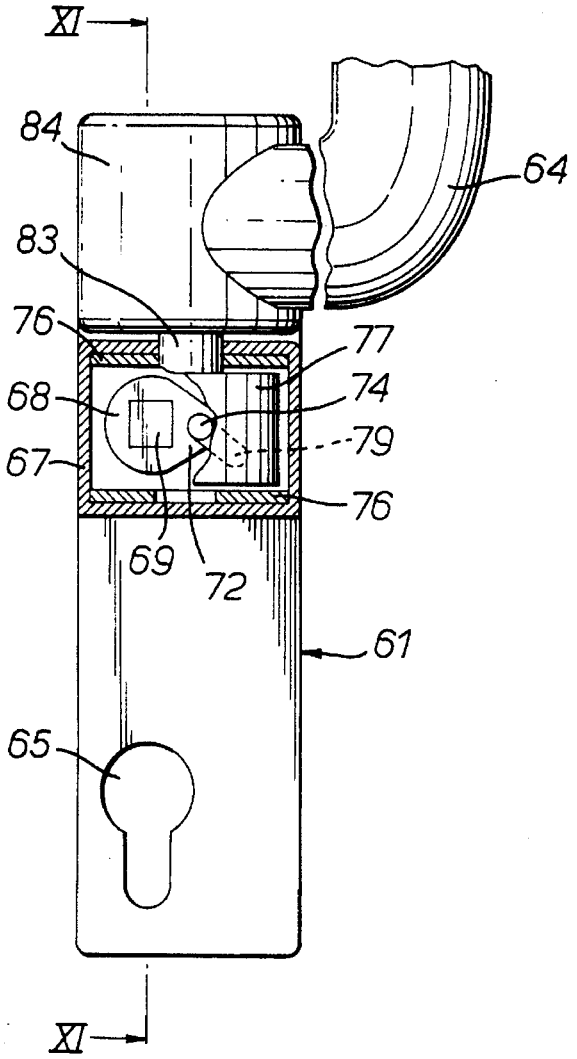
FIG. 9 shows a front view, in partial section, of a second embodiment form of the part of a handle mounting according to FIG. 1 having a gearing according to the invention, which part acts on a door lock.
Figure 10:
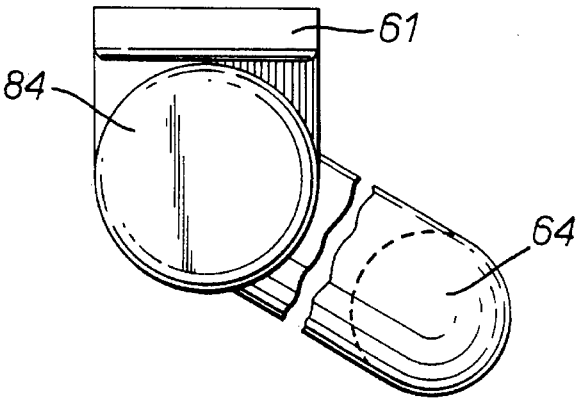
FIG. 10 shows a top view of the mounting part according to FIG. 9.
Figure 11:
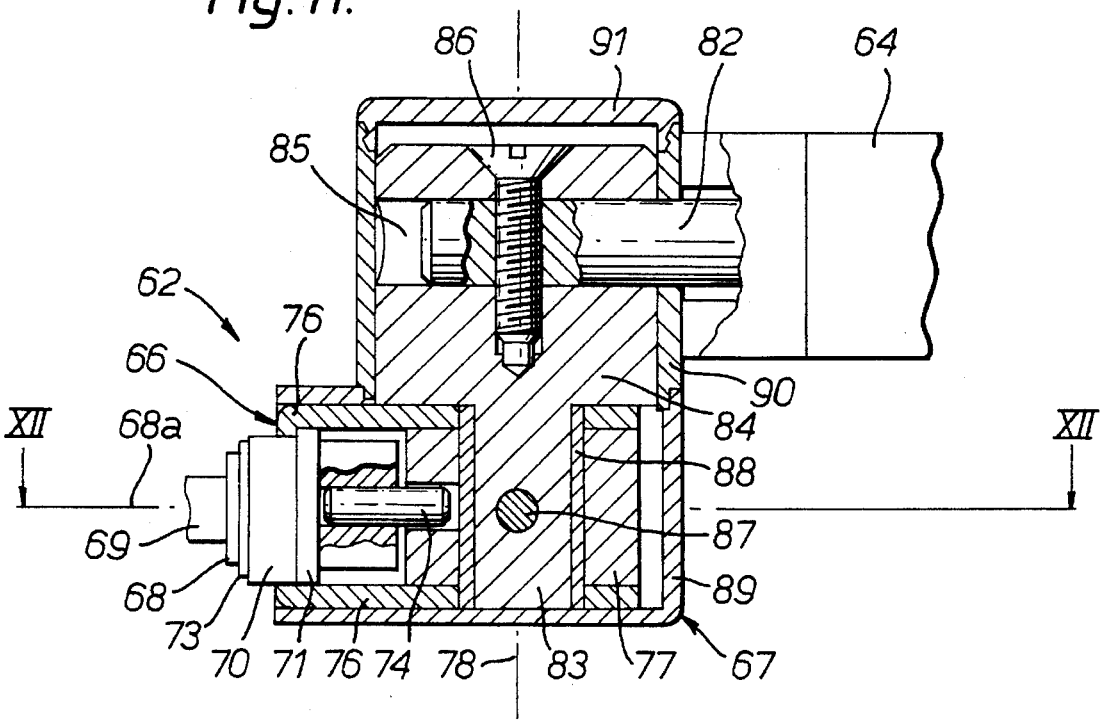
FIG. 11 shows a section along line XI—XI of FIG. 9.

The locking of the latch or bolt is generally effected by means of springs installed in the lock. In addition, a pair of rollers 77 with one of the two guide parts 80, 80*a* (FIG. 13) which can be used optionally for doors opening to the right or to the left can be associated with the gearing (FIG. 13). A driver sleeve whose driver pin is correspondingly offset can be associated with the roller having the cut out portion 79*a*. It would also be possible to install the driver sleeve 68 in a position which is rotated by 180° relative to FIG. 9 and to install the roller 77 in a corresponding manner in a position rotated by 180° around the first axis 68*a*. Alternatively, the cut out portion 79, 79*a* could be constructed as a straight or arc-shaped elongated hole guiding the driver pin 74 at both sides. In either case, the gear ratio of the rotating movements to be converted or the gear ratio between the two gearing parts 77 and 68 can be adjusted by the angle enclosed by the guide parts 80, 80*a* with the second rotational axis 83.

The outer cover 67 contains a rigidly arranged portion 89 which is associated with the holder part 62 in a fixed manner and is open at the side (FIG. 11) to enable a mounting of the receptacle 63 and the rod 83. The outer cover 67 further contains a portion 90 which is rotatably connected with the portion 89 and mounted on the receptacle 84, and a portion 91 which is pressed onto the portion 90 after tightening the fastening screw 86. The connections can be produced in the conventional manner by snap-on fastenings or the like so that only the joints between the portions 89, 90 and 90, 91, respectively, are visible in the surface of the mounting part described with reference to FIGS. 9 to 12, which joints are hardly perceptible from a distance. According to FIG. 12, the portion 89 advisably has a mounting hole 92 through which the fastening screw 87 can be loosened or tightened also when the mounting is securely mounted should it be desired to unscrew or insert and then fasten the rod 83 from the side.

The gearing described with reference to FIGS. 9 to 14 also allows a comparatively narrow construction of the lower part or of the entire holder part 62 in the direction of the second axis 78, since the driver pin 74 is arranged parallel to the first axis 68*a* and the roller 77 in front of the driver sleeve 68. This is the case particularly when the driver pin 74 is arranged inside an imaginary cylinder corresponding to FIGS. 9 and 11, whose diameter is at most equal to the large diameter of the driver sleeve 68, since in this case the width of the roller 77 also needs to be, at most, great enough to correspond to the diameter of the imaginary cylinder. The gearing can nevertheless be constructed so as to be comparatively stable and the driver pin 74 can be given a comparatively large diameter since the guide parts 80*a,b* can be constructed so as to be comparatively steep. The height of this mounting part over the door leaf 29 depends substantially only on the diameter of the roller 77 and on the strength of the arm 72 as in the embodiment form according to FIGS. 3 to 8. The distance of the two axes 68*a*, 78 has influence only on the width of the mounting since the two axes come to rest substantially adjacent to one another in the mounted state.

At the other end the handle 64 can be fastened at a second receptacle corresponding to the receptacle 10 according to FIG. 1 which can be rotatably supported in another rigid holder part. The holder part can be provided with a roller corresponding to the roller 77 similar to FIGS. 7 and 8 and the latter can be connected with a corresponding receptacle. In this case, also, corresponding stops for limiting the rotating movement can be associated with the stops according to FIGS. 7 and 8. As in the first embodiment form, the second holder part could also be entirely dispensed with.

The invention is not limited to the described embodiment examples which can be modified in a number of ways. In particular, in a kinematic reversal of FIGS. 9 to 12, the driver pins can also be arranged at the second gearing part and the guide parts at the first gearing part. Further, it goes without saying that the individual members shown in FIGS. 3 to 8 can also be applied in an analogous manner in the embodiment form according to FIGS. 9 to 14 and vice versa. Further, the first gearing part could also act on other members as an actuating member for a lock nut, i.e. particularly on such members enabling an actuation of the latch or bolt in another manner. As an alternative to FIGS. 3 to 5, it could further be provided to insert the rod 32 into the roller 27 from the opposite side so as to arrange the receptacle 8 below the roller 27 in FIG. 1. The rod 83 and the roller 77 could be arranged in a corresponding manner in the embodiment form according to FIGS. 11 and 12. It is also possible to mount the respective mounting plates 18 and 66 in a position which is rotated by 180° around the axes 20*a* and 68*a* when the rest of the parts are adapted in a corresponding manner. Similar considerations apply to the holder parts 11 according to FIGS. 7 and 8 and the respective receptacles 10 which could also be situated below the rollers 53 like the free ends of the rods 54. Finally, the mounting pins 45 and 82 could be constructed as fixed structural component parts of the receptacles 8 and 84, respectively, in which case they would be inserted in corresponding receiving openings of the handles and then connected with the latter by transverse pins or the like.

The application of the described gearing is not limited to the example shown in FIG. 2. In particular, the handle mounting can also be provided with a moving and stationary wing on double-wing doors. In so doing, the described gearing preferably acts on the lock of the moving wing, while another gearing can be provided in a manner known per se for acting on a driving rod actuating a bolt or latch.

We claim:

1. Door comprising a door leaf; a lock arranged in the door leaf and having a locking member; a handle; at least one fastening device for mounting the handle on the door leaf, the handle being supported in the fastening device so as to be swivelable around a swivel axis arranged substantially vertically and parallel to the door leaf; and a deflecting mechanism which converts at least a swiveling of the handle effected in a preselected swiveling direction into an opening movement of the locking member, the deflecting mechanism including a gearing and having a first rotatable gearing part (20, 68) acting on the locking member (4) and a second gearing part (27, 77) which is rotatable around the swivel axis (12) and connectable with the handle (6, 64), said gearing parts (20, 68; 27, 77) having members (24, 74; 40, 80) which are in direct positive-locking contact with each other in said preselected swiveling direction of the second gearing part.

2. Door according to claim 1, wherein the gearing parts (20, 68 and 27, 77) are constructed in such a way in a door to be opened outward that an open position of the locking member (4) can be brought about by pressing on the handle (6) in the direction of the door leaf (29).

3. Door according to claim 1, wherein the gearing parts (20, 68 and 27, 77) are constructed in such a way in a door to be opened inward that an open position of the locking member (4) can be brought about by pulling on the handle (6).

4. Door according to claim 1, wherein the handle (6) includes a handle bar having two angled ends (5, 9) and arranged substantially vertically, one of the ends (5) being associated with the fastening device, while the other end (9) is supported so as to be swivelable around an axis situated coaxially relative to the swivel axis (12) in a second holder part (11) arranged vertically above or below the fastening device.

5. Handle mounting for a door having a door leaf, a lock, a locking member and a handle, the handle mounting comprising at least one fastening device for mounting the handle on the door leaf in such a manner that the handle is supported in the fastening device so as to be swivelable around a swivel axis arranged substantially vertically and parallel to the door leaf, and a deflecting mechanism which converts at least a swiveling of the handle effected in a preselected swiveling direction into an opening movement of the locking member, said deflecting mechanism including a gearing which has a first rotatable gearing part (20, 68) for acting on the locking member (4) and for being rotated about a second axis and a second gearing part (27, 77) which is rotatable around the swivel axis (12) and is connectable with the handle (6, 64), said gearing parts (20, 68; 27, 77) having members which are in direct positive-locking contact with each other in said preselected swiveling direction of the second gearing part.

6. Handle mounting according to claim 5, wherein the first gearing part (20, 68) is rotatable around a first axis (20*a*, 68*a*) extending substantially perpendicularly to the swivel axis (12), and the second gearing part (27, 77) is arranged substantially in front of the first gearing part in the direction of the first axis and is rotatable around a second rotational axis (28, 78) which is situated coaxially relative to the swivel axis (12) .

7. Handle mounting according to claim 5, wherein the driver pin (24, 74) is arranged inside an imaginary cylinder whose diameter is at most equal to the greatest diameter of the driver sleeve (20, 68).

8. Handle mounting according to claim 5, wherein the guide part (80, 80*a*) is worked into the outer surface area of the roller (77).

9. Handle mounting according to claim 8, characterized in that the guide part (80, 80*a*) is a straight-line guide arranged at an inclination to the second axis (78).

10. Handle mounting according to claim 5, wherein the first gearing part (20, 68) is a driver sleeve receiving an actuating member (21, 69) for said locking member and having a driver pin (24, 74) which is arranged parallel to and at a distance from the first axis (20*a*, 68*a*), while the second gearing part (27, 77) includes a roller which contains a guide part (40; 80; 80*a*) cooperating with the driver pin and is rotatably mounted around said swivel axis (12).

11. Handle mounting according to claim 10, wherein the guide part (80, 80*a*) is formed from wall portions defining an elongated hole arranged diagonally relative to the second axis (78) for the purpose of converting the rotational movement of the handle (64) into a rotational movement of the actuating member (69) in opposite rotational directions.

12. Handle mounting according to claim 11, wherein the guide part (40) is formed by a wall portion (41*a,b*) of a recess (37*a,b*) constructed in the outer surface area of the roller (27).

13. Handle mounting according to claim 12, wherein the recess (37*a,b*) has an arc-shaped cross section and the guide part (40) is formed by a pin having an axis arranged parallel to and at a distance from the second axis (28).

14. Handle mounting according to claim 12, wherein a base (38) defining the recess (37*a,b*) has two bore holes (39*a,b*) for optional insertion of the guide part (40).

15. Handle mounting according to claim 14, characterized in that the roller (27) has recesses (39*a,b*) at both ends which reach to the base (38) and the bore holes (39*a,b*) completely penetrate the base (38).

16. Handle mounting according to claim 5, wherein the gearing is mounted in a lower part having a mounting plate (18, 66) for fastening at the door and for rotatably supporting the first gearing part and two holding plates (25, 76) which project vertically from the mounting plate (18, 66) and serve to support the second gearing part so as to be rotatable.

17. Handle mounting according to claim 16, wherein the first gearing part (20, 68) is a driver sleeve receiving an actuating member (21, 69) for said locking member and having a driver pin (24, 74) which is arranged parallel to and at a distance from the first axis (20*a*, 68*a*), while the second gearing part (27, 77) includes a roller which contains a guide part (40; 80; 80*a*) cooperating with the driver pin and is rotatably mounted around said swivel axis (12), the two holding plates (25, 76) have a bearing bore hole (26) which is arranged coaxially relative to the second axis (28, 78) and serves for the rotatable support of the roller (27, 77).

18. Handle mounting according to claim 17, wherein a rod (32, 83) penetrating a center passage of the roller is supported in the bearing bore holes (26) so as to be rotatable.

19. Handle mounting according to claim 18, wherein the rod (32, 83) is provided with a receptacle (8, 84) which projects out of one of the holding plates (25, 76) and serves for the mounting of the handle (6, 64).

20. Handle mounting according to claim 18, wherein bearing sleeves (35) with non-circular central openings are supported in the bearing bore holes (26) so as to be rotatable, the roller (27) has an axial passage with a correspondingly non-circular inner cross section, and the rod (32) is provided with a correspondingly non-circular outer cross section.

21. Handle mounting according to claim 18, wherein a bearing sleeve (88) which projects through a central passage of the roller and receives the rod (83) is supported in the bearing bore holes so as to be rotatable.

22. Handle mounting according to claim 21, wherein at least the roller (77) and the bearing sleeve (88) are provided with radial bore holes for receiving fastening members (87) so that the roller (77) is connected with the rod (83) so as to be fixed with respect to rotation and axial displacement relative to it.

23. Handle mounting according to claim 18, wherein the rod (32) has a non-circular outer cross section and the receptacle (8) has a first passage with a non-circular inner cross section corresponding to the outer cross section of the rod (32).

24. Handle mounting according to claim 23, wherein the receptacle (84) has a second passage (85) for receiving a fastening member (82) anchored in the handle (64), which second passage (85) is arranged so as to be substantially perpendicular to the first passage.

25. Handle mounting according to claim 5, wherein the swivel axis and the second axis (68*a*, 78) are arranged at a distance from one another and do not intersect one another.

26. Handle mounting according to claim 5, wherein the swivel axis and the second axis (20*a*, 28 and 68*a*, 78) are arranged so as to be substantially perpendicular to one another.

27. Handle mounting according to claim 5, wherein said roller has an outer contour and that the guide part (40) includes a pin which is substantially parallel to the swivel axis (28) and arranged inside the outer contour.

28. Handle mounting according to claim 5, wherein the swivel axis and the second axis (20*a*, 28) intersect one another.

* * * * *